US007574826B2

(12) United States Patent
Evans

(10) Patent No.: US 7,574,826 B2
(45) Date of Patent: Aug. 18, 2009

(54) EMERGENCY DOOR OPENING ACTUATOR

(76) Inventor: Rob J. Evans, 7043 W. Carol Ann Way, Peoria, AZ (US) 85382

( * ) Notice: Subject to any disclaimer, the term of this patent is extended or adjusted under 35 U.S.C. 154(b) by 670 days.

(21) Appl. No.: 11/084,667

(22) Filed: Mar. 18, 2005

(65) Prior Publication Data

US 2005/0252613 A1 Nov. 17, 2005

Related U.S. Application Data

(63) Continuation-in-part of application No. 10/964,041, filed on Oct. 12, 2004, and a continuation-in-part of application No. 10/845,748, filed on May 13, 2004.

(51) Int. Cl.
*E05F 15/20* (2006.01)

(52) U.S. Cl. ..... 49/8; 49/4; 49/7; 49/13

(58) Field of Classification Search ..... 49/1, 49/4, 7, 8, 13, 26; 52/1
See application file for complete search history.

(56) References Cited

U.S. PATENT DOCUMENTS

| | | | | |
|---|---|---|---|---|
| 1,449,954 | A | 3/1923 | Radoush | |
| 3,685,567 | A | 8/1972 | Pemberton et al. | |
| 3,834,076 | A | 9/1974 | Vallee et al. | |
| 4,002,229 | A | 1/1977 | Washington | |
| 4,048,630 | A | 9/1977 | Deming et al. | |
| 4,065,100 | A | 12/1977 | Walsh | |
| 4,104,834 | A * | 8/1978 | Anghinetti et al. | 52/1 |
| 4,147,197 | A | 4/1979 | Bailey et al. | |
| 4,197,675 | A | 4/1980 | Kelly | |
| 4,338,526 | A | 7/1982 | Martin et al. | |
| 4,365,250 | A | 12/1982 | Matsuoka et al. | |
| 4,464,651 | A | 8/1984 | Duhame | |
| 4,539,555 | A | 9/1985 | Tefka | |
| 4,785,293 | A | 11/1988 | Shearer et al. | |
| 4,819,551 | A | 4/1989 | Vole | |
| 4,884,832 | A | 12/1989 | Bungard | |
| 4,904,880 | A | 2/1990 | Yoshida | |

(Continued)

FOREIGN PATENT DOCUMENTS

| | | |
|---|---|---|
| AU | A-69694/81 | 3/1982 |

(Continued)

*Primary Examiner*—Jerry Redman
(74) *Attorney, Agent, or Firm*—Schmeiser, Olsen & Watts LLP

(57) ABSTRACT

An emergency door opening actuator includes electrical switches that are at least one of normally open and normally closed. The electrical switches may be connected accordingly in parallel or in series to terminals of an overhead door operator. The terminals may correspond to a push button circuit, an obstruction sensing circuit, an alarm system circuit, and/or a door opening circuit. The emergency door opening actuator may take advantage of a protocol in the operator to cause the overhead door to open during an emergency condition to facilitate egress. Likewise, the emergency door opening actuator may cause that the overhead door cannot close by signaling the protocol in a predetermined way when the switches are actuated by an emergency condition. The electrical switches may be mechanically actuated when at least one fusible link is broken. The emergency door opening actuator may include an automatic mechanical stop and/or a test release mechanism.

20 Claims, 8 Drawing Sheets

U.S. PATENT DOCUMENTS

| | | | |
|---|---|---|---|
| 4,919,235 | A | 4/1990 | DelSavio |
| 4,938,454 | A | 7/1990 | Jones |
| 5,022,452 | A | 6/1991 | Burrell |
| 5,070,442 | A | 12/1991 | Syron-Townson |
| 5,072,973 | A | 12/1991 | Gudgel et al. |
| 5,245,879 | A | 9/1993 | McKeon |
| 5,263,527 | A | 11/1993 | Marlatt et al. |
| 5,482,103 | A | 1/1996 | Burgess et al. |
| 5,576,581 | A | 11/1996 | Iannuzzi et al. |
| 5,642,092 | A | 6/1997 | Dunne et al. |
| 5,647,576 | A | 7/1997 | Kataoka |
| 5,652,563 | A | 7/1997 | Maus |
| 5,812,391 | A | 9/1998 | Mehalshick |
| 5,850,865 | A | 12/1998 | Hsieh |
| 5,896,907 | A | 4/1999 | Dever et al. |
| 6,014,307 | A | 1/2000 | Crimmins |
| 6,046,562 | A | 4/2000 | Emil |
| 6,145,571 | A | 11/2000 | Snyder |
| 6,155,324 | A | 12/2000 | Elliott et al. |
| 6,225,768 | B1 | 5/2001 | Cookson et al. |
| 6,346,889 | B1 | 2/2002 | Moss |
| 6,484,784 | B1 | 11/2002 | Weik, III et al. |
| 6,503,141 | B2 | 1/2003 | Meneely, Jr. |
| 6,611,205 | B2 | 8/2003 | Guthrie et al. |
| 6,653,810 | B2 | 11/2003 | Lo |
| 6,662,848 | B2 | 12/2003 | Goodman et al. |
| 6,710,714 | B2 | 3/2004 | Conway |
| 6,712,116 | B2 | 3/2004 | Beaudoin et al. |
| 6,737,821 | B1 | 5/2004 | Fitzgibbon et al. |
| 6,771,181 | B1 | 8/2004 | Hughen, Jr. |
| 2002/0183008 | A1 | 12/2002 | Menard et al. |
| 2004/0142654 | A1 | 7/2004 | Stammer et al. |
| 2004/0183677 | A1 | 9/2004 | Fitzgibbon |

FOREIGN PATENT DOCUMENTS

| | | |
|---|---|---|
| AU | A-65969/86 | 5/1987 |

* cited by examiner

EMERGENCY DOOR OPENING ACTUATOR

This application is a continuation-in-part of U.S. patent application Ser. No. 10/964,041, filed Oct. 12, 2004, entitled EMERGENCY DOOR OPENING ACTUATOR, and a continuation-in-part of U.S. patent application Ser. No. 10/845,748, filed May 13, 2004, and entitled CONTROL SYSTEM AND TEST RELEASE DEVICE FOR AN OVERHEAD DOOR, both by the same inventor and both of which are incorporated herein by reference.

BACKGROUND OF THE INVENTION

1. Technical Field

This invention generally relates to an emergency actuation system for overhead doors, and specifically to an emergency door opening actuator that causes an automatic overhead door to open and remain open in case of a fire or associated high temperatures.

2. State of the Art

Fire doors with actuators that cause the doors to close in emergency conditions are known. These fire door systems generally close overhead doors under the influence of gravity. Many such doors have fusible links that melt and break at temperatures above a certain range. These door systems thus have mechanical door closing actuation mechanisms and mechanical closing mechanism. Some fire doors have been developed that have electric powered door closing mechanisms and electronic door closing actuation mechanisms.

Other door systems have been developed for assuring ventilation when a high level of a toxic gas such as carbon monoxide has been detected. Once again, these door systems include electronic sensors and are actuated to open a door when a minimum level of carbon monoxide or other gas is detected.

There is a deficiency of devices for assuring egress from a garage or house through the garage door. Several persons including fire fighters have lost their lives or been severely injured by being trapped in a garage during a fire. These deaths and injuries continue to occur, indicating a need in the art for a simple, inexpensive, yet effective device that will cause an overhead door to open and allows egress in the case of a fire.

DISCLOSURE OF THE INVENTION

The present invention relates to emergency door actuation systems for overhead doors in general, and specifically to an emergency door opening actuator that causes an automatic overhead door to open in case of a fire or associated high temperatures.

An emergency door opening actuator in accordance with the present invention may include electrical switches that are at least one of normally open and normally closed. These electrical switches may be connected accordingly in parallel or in series to terminals of an overhead door operator. The terminals may correspond to a push button circuit, an obstruction sensing circuit, and/or an alarm system circuit. The operator may have an existing protocol for responding to signals from a push button circuit and an obstruction sensor circuit. Thus, the emergency door opening actuator may take advantage of the protocol to cause the overhead door to open during an emergency condition to facilitate egress. Likewise, the emergency door opening actuator may cause that the overhead door cannot close. This may be achieved by signaling the protocol in a predetermined way when the switches are actuated by an emergency condition. The electrical switches may be mechanically actuated when at least one fusible link is broken.

In a simple form, an emergency door opening actuator may include a switch actuator movable between a first position and a second actuation position. The switch actuator may engage an electrical switch in the first position. The switch actuator may be coupled to at least one fusible link. The switch actuator may also be coupled to an anchor that is adapted for mounting to a structural member of a building/house. The anchor may take the form of a releaseable lever or test release mechanism. The releaseable lever or test release mechanism may be connected to the switch actuator. The releaseable lever may be serially connected to the switch actuator by a sash that includes the fusible link. The fusible link may be configured such that when it breaks, the switch actuator moves to its second position and actuates the electrical switch.

The emergency door opening actuator may include a mechanical stop that may form part of or be connected to the switch actuator. A door lifting shaft engaging element may be included in which the door lifting shaft engaging element is adapted to be fixed to a door lifting shaft. The door lifting shaft engaging element may be engaged by the mechanical stop when the fusible link breaks. The mechanical stop may be integral with the switch actuator.

The door lifting shaft engaging element is a toothed wheel or star gear directly engageable by a stop in the form of a pawl. On the other hand, the mechanical stop may be spaced from the door lifting shaft and may be connected to the switch actuator by a link.

The emergency door opening actuator may include a housing adapted to be mounted on a door jam to receive an end of a door lifting shaft. The housing may support the electrical switch and the switch actuator. The housing may also support one or both of a door lifting shaft engaging element and a mechanical stop.

The emergency door opening actuator may take the form of a kit that includes a housing, a door lifting shaft engaging element rotatably supportable in the housing in a centered relation on an axis of rotation in the housing, a mechanical stop supported in the housing at a position radially spaced from the axis of rotation, and a sash connectable with the mechanical stop for moving the stop between an engaged and a nonengaged state relative to the door lifting shaft engaging element.

The emergency door actuator kit may include at least one electrical switch supported in the housing. The electrical switch may be adapted for connection to an electrical overhead door operator. The kit may also include a switch actuator. The switch actuator may include the mechanical stop and an electrical switch engagement element operatively connected to the electrical switch. The emergency door actuator kit may also include a releaseable lever or test release mechanism and a mounting mechanism for mounting the test release mechanism. The sash may have a first end connectable with the mechanical stop and a second end connectable with the test release mechanism.

The fusible link may be one of a plurality of fusible links. The door opening actuator may further include a sash that includes the fusible link and couples the switch actuator to the anchor. The plurality of fusible links may be located at key locations in the building/house for release of the sash during fires or high heat in the key locations.

The emergency door opening actuator may include a housing that supports one or more of the switch, the switch actuator, and a spring. The housing may have a mounting structure thereon adapted for attachment of the housing on a structural member proximate to an automatic door operator.

In another simple form, the present invention may include a method of causing an overhead door to automatically open during an emergency. The method may include mechanically coupling at least one electrical switch to at least one fusible link and connecting the at least one electrical switch to an automatic door operator.

Additionally, the method may include engaging the electrical switch with a switch actuator in a non-emergency state, and then moving the switch actuator and actuating the electrical switch when the fusible link is broken by an environment having a predetermined temperature.

The method may include testing a system that includes the electrical switch and the fusible link. The step of testing may include slackening a sash connected to the electrical switch. The sash may be connected to or include the fusible link. The method may include actuating a mechanical stop in response to slack in the sash and causing the mechanical stop to contact a door lifting shaft engaging element. The method may thus or otherwise include the step of inhibiting movement of the door lifting shaft engaging element in a first rotational direction. The step of inhibiting movement of the door lifting shaft engaging element may permit movement of the door lifting shaft engaging element in an opposite second rotational direction. The method may also advantageously include automatically mechanically stopping the overhead door from closing.

In another simple form, the present invention may include a method of causing an overhead door to automatically open during an emergency. The method may include mechanically coupling a switch actuator to at least one fusible link, and connecting at least one electrical switch to at least one terminal of an automatic door operator to transmit an indication to the operator similar to that which is received from a button circuit when an automatic door operator button is pressed. This aspect of the invention may also provide one or more aspects of a method of installing and/or a method of manufacturing. The method of causing the overhead door to automatically open may include engaging the electrical switch with the switch actuator in a non-emergency state. The method may also include disengaging the switch actuator from the switch and releasing the electrical switch when the fusible link is broken by a predetermined temperature. As may be appreciated, the method may include connecting a plurality of switches to a plurality of terminals in the automatic door operator to transmit indications similar to one or more of an indication that the button has been pressed, that an obstruction has been detected, that an alarm condition exists, and that the door must be raised.

The method of causing the overhead door to automatically open wherein the fusible link is integral with the sash may include anchoring a distal end of the sash to a point in a building/house, connecting a proximal end of the sash to the switch actuator, and holding the switch actuator in a non-emergency position against a bias of the switch actuator. The method of causing the overhead door to automatically open may include distributing a plurality of fusible links at selected positions on the sash for response to high temperatures at the selected positions in the building/house. In one case the method may include locating a first of the fusible links proximate the operator and locating a second of the links on an opposite side of a wall from the operator. The method may also include locating at least one of the fusible links at a remote location within the building/house.

In another simple form, the present invention may include an emergency door opening operator having an overhead door operator for raising and lowering an overhead door. A switch actuator may be movable between a first position and a second actuation position in the actuator. The switch actuator may engage an electrical switch in the first position. The switch actuator may be coupled to at least one fusible link as described above. The switch actuator may be coupled to an anchor that is adapted for mounting to a structural member of a building/house. In this way, the electrical switch may be connected to at least one terminal of the overhead door operator. Furthermore, the fusible link may be configured such that when it breaks, the switch actuator moves to its second position and releases the electrical switch.

The at least one terminal may be one of a plurality of terminals connected to a plurality of indication circuits in the overhead door operator. The electrical switch may be one of a plurality of electrical switches that are connected to the plurality of terminals of the operator. The fusible link may be configured such that when it breaks, the switch actuator moves to its second position and releases the plurality of electrical switches.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to emergency actuation systems for overhead doors in general, and specifically to an emergency door opening actuator that causes a door to open in case of a fire or associated high temperatures.

Figure 1:
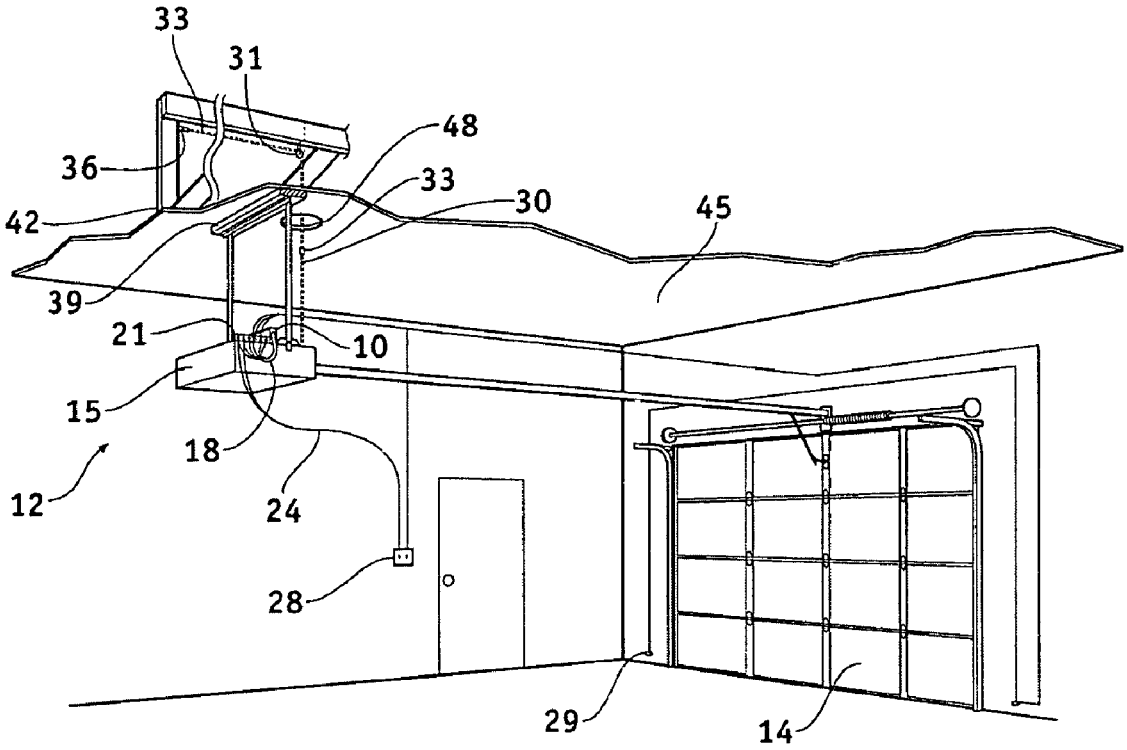
FIG. 1 is a perspective view of an emergency door opening actuator incorporated with an operator and overhead door system according to an embodiment of the present invention.

FIG. 1 shows an emergency door opening actuator 10 incorporated with an automatic door opening system 12 for causing a door 14 to be opened in case of a fire. The door opening actuator 10 may be mounted to an operator 15 of the automatic door opening system 12 or to proximal structural members that are part of or connected to a building in which the door opening actuator is to be used. It is to be understood that references to building herein include residential homes.

As shown, at least one line 18 may extend from the door opening actuator 10 and be connected to a terminal strip 21 to which the push button circuit 24 and the obstruction circuit 27 may also be connected. As may be appreciated, the push button circuit 24 connects the operator 15 to the push button 28 that may be pressed by a user of the automatic overhead door system 12 in a conventional manner. Furthermore, the obstruction circuit 27 includes an optical sensor 29 for detection of an obstruction in a conventional manner. The connections of the line 18 to the terminal 21 may be advantageously made to effectuate the functions of the present invention as will be described in greater detail below.

A sash 30 may couple the door opening operator 10 to one or more fusible links 33 that help make up the sash 30. The sash 30 is also for the purpose of coupling the door opening actuator 21 to an anchor 36. It is to be understood that the sash 30 may be any one of a number of flexible elements such as, rope, wire, cable, or chain. The sash 30 may include rigid linkages that may be formed of rods, channel members, bars, posts, or levers. The sash may also include one or more tension adjusting mechanisms and removable links. The sash may include any combination of the above described elements.

The operator 15 and the door opening actuator 10 may be suspended from exposed rafters 39, or rafters 42 enclosed behind a drywall ceiling 45 in a known manner. The sash 30 may be extended through an opening 48 in the drywall ceiling. Furthermore, the sash 30 may be extended through any number of walls throughout the building and may be routed around corners by rollers 31 or eye bolts to enable selective placement of additional fusible links 33 at any location throughout the building. Thus, the sash 30 will be released when a fire or associated high temperatures are experienced at any of the locations.

Figure 2:
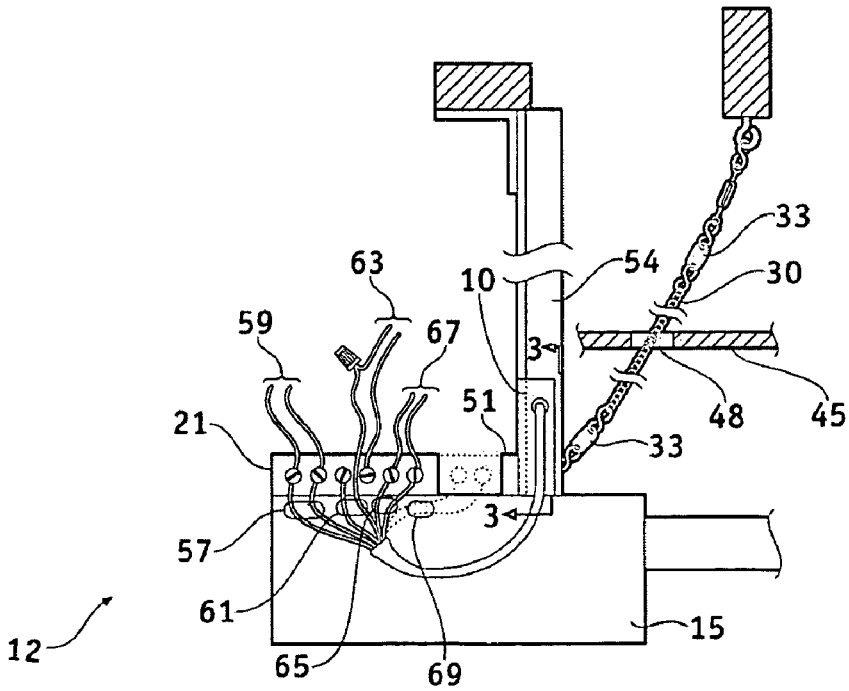
FIG. 2 is a side view of the operator and the emergency door opening actuator of FIG. 1.

FIG. 2 is a side view of the operator 15 and door opening actuator 10 of FIG. 1. As shown, the operator may have a mounting flange 51 fastened to one or more suspension member 54, or may be mounted in any conventional manner. The door opening actuator 10 may also be mounted to the mounting flange 51. The door opening actuator 10 may be at least partially supported in an attractive housing that may be powder coated with a fire resistant paint. The door opening actuator 10 may thus become substantially integral with the operator 15 and the overall door opening system 12. In fact, the door opening actuator may be incorporated directly within the operator housing and may be made part of an operator by a manufacturer. This is due, in part, to the door opening actuator's complete compatibility with the operators available on the market today.

The terminal strip 21 may be exposed or may be enclosed in the operator 15. Thus, the terminal strip 21 is shown in a manner that may be considered schematic in FIG. 2. The line 18 may include a sheath that encloses a plurality of wire pairs that may be connected to the terminals of the terminal strip 21. A first pair of wires 57 may be connected in series to a pair of wires 59 forming the push button circuit 24 when the push button circuit is a normally closed circuit. (A series connection with the obstruction sensor circuit 27 is shown in FIG. 2.) Alternatively, the first pair of wires 57 may be connected in parallel to a pair of wires 59 forming the push button circuit 24 as shown by connections at the two left most terminals in FIG. 2 when the push button circuit 24 normally operates as an open circuit. A second pair of wires 61 may be connected in series with a pair of wires 63 forming the obstruction sensor circuit 27 since the obstruction sensor circuit 27 normally operates as a closed circuit. It is to be understood that series or parallel connections may be applied depending on whether the circuit to which the respective switches are to be connected normally operate as closed or opened circuits. As such, a third pair of wires 65 may be connected in series or parallel with a pair of wires 67 forming an alarm circuit. Another pair of wires 69 may be provided in additional to or in substitution of the other pairs. The pair of wires 69 may be connected to terminals that are connected to logic and/or protocol configured specifically for preferentially sending a door 14 open in the case of an emergency. This logic and/or protocol may be provided in the operator by the manufacturer similar to the protocols for each of the other circuits to which the other terminals are connected. That is, the terminals shown in dashed lines in FIG. 2 may be a pair of terminals dedicated to the safety function of the present invention. Thus, in the event that a manufacturer wishes to implement the advantages of the present invention directly into a particular operator, doing so may be accomplished by including the door opening protocol and an internal or external connection analogous to the terminals shown in dashed lines for connection to wires analogous to wires 69 connected to a door opening actuator. This may be done in addition to (for redundancy), or in place of the rest of a door opening actuator analogous to door opening actuator 10 that is to be connected to the other terminals and to the other circuits including the push button circuit 24 and the obstruction sensor circuit 27.

Figure 3:
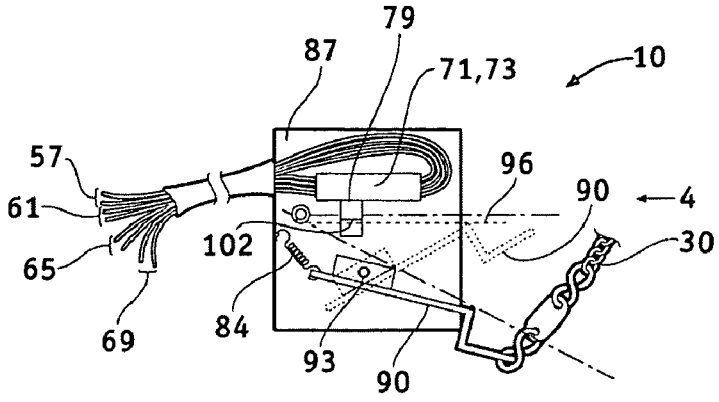
FIG. 3 is a sectional view of the emergency door opening actuator taken along line 3-3 of FIG. 2.
Figure 4:
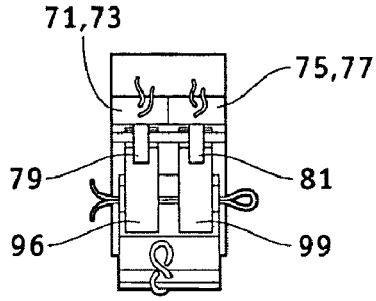
FIG. 4 is an end view taken in a direction of arrow 4 of FIG. 3.
Figure 5:
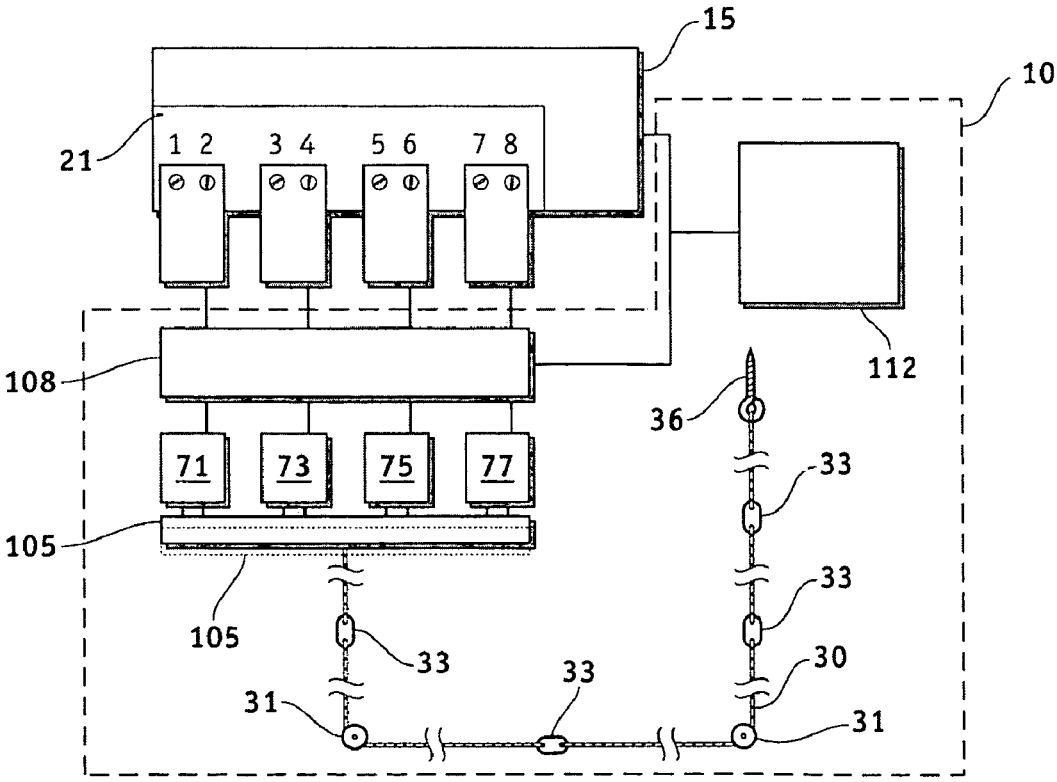
FIG. 5 is a diagrammatic view of the emergency door opening actuator and operator configured according to an embodiment of the present invention.

The pairs of wires 57, 61, 65, and 69 are connected to respective electrical switches 71, 73, 75, and 77 shown in FIGS. 3-5. The switches may have two switches housed together as shown in FIGS. 3 and 4. In this case, pressing button 79 actuates both switches 71 and 73 simultaneously. Pressing button 81 may actuate both switches 75 and 77 simultaneously. As shown, a spring 84 may be secured to a housing 87 and to a switch actuator 90 for biasing the switch actuator toward a position in which it does not engage the buttons 79 and 81. On the other hand, the switch actuator could take any of a number of forms and may be moved into its non engaging condition by any of a variety of biasing mechanisms including under the force of gravity. While FIGS. 3 and 4 depict the switch actuator as including an actuation lever 90 that is pivoted on a pin 93, the switch actuator may alternatively take the form of a plunger or other movable mechanism that is capable of moving between two positions. FIGS. 3 and 4 also show intermediate spring levers 96 and 99 that are moved by the actuation lever 90 and engage the buttons 79 and 81 in a resilient manner. These spring levers 96 and 99 thus have the advantage of protecting the switches 71, 73, 75, and 77 against forces from a rigid switch actuator that may be too great and cause damage. As may be appreciated, the actuation lever 90 and the spring levers 96 and 99 of the exemplary embodiment of FIGS. 3 and 4 works in concert and together provide the switch actuator.

During installation of the door opening actuator 10, the sash 90 must be pulled so that the actuator lever 90 is in a first position indicated by the actuation lever 90 shown in dashed lines in FIG. 3. The sash is anchored and tensioned as desired.

The spring levers 96, 99 in this position resiliently press the buttons 79 and 81 into their depressed position shown at 102.

In one example, the switch 71 is normally closed when not pressed. However, in the embodiment of FIGS. 3 and 4, the initial position for operation of the door opening actuator 10 is with the button 71 pressed. Thus, during use, switch 71 is held in the open position.

Therefore, when a fusible link breaks, the actuation lever is released and is biased into its normally closed position. Button 79 is disengaged by the actuation lever 90 and the spring lever 96 so that the first switch 71 moves into its closed condition. As may be appreciated, the series connection of the first pair of wires 57 from the first switch 71 to the first pair of terminals and the push button circuit 24 will actuate door 14 as though the push button 28 had been pressed when the circuit 24 is a normally closed circuit. Alternatively, a parallel connection of first pair of wires 57 from the first switch 71 to the first pair of terminals and the push button circuit 24 will actuate the door 14 as though the push button 28 had been pressed when the circuit 24 is a normally open circuit. Thus, if the door 14 is originally closed when a fusible link breaks, the door 14 will be caused to go up by the closure of switch 71 under the same protocol as for operation of the door by the push button 28. At the same time, the second switch 73 is normally open when the button is not engaged so that during operation with the button 79 pressed, the second switch is held closed. When the fusible link breaks, the actuation lever 90 is released and the second switch is moved to the open condition. This may send a signal to the operator akin to that received when an obstruction is detected by the sensor 29. Since the door 14 is closed or already going up, the protocol may do nothing to change the action by the operator as under similar conditions with an obstruction detected by the sensor 29. Alternatively, the protocol may completely interrupt wiring to the sensor to prevent the door from closing.

As shown in FIG. 2, the second switch 73 may be connected in series by the second pair of wires 61 from the door opening actuator 10 with the pair of wires from the obstruction circuit 27. This is advantageous because the obstruction circuit operates as a normally closed circuit and is opened when an obstruction is detected. Therefore, holding the second switch 73 in the closed condition absent a fire enables the second switch to function properly when placed in series with the obstruction circuit. In this configuration, it can be appreciated that as soon as a fusible link is broken, the emergency door opening actuator will open the circuit formed in series with the obstruction sensing circuit 27 and the door 14 cannot close.

In the case of the door 14 being already open, actuation of the door opening actuator 10 when a fusible link breaks will cause the first switch to close, which will start closing the door. However, the second switch will be opened causing the door 14 to either stop of reverse and go up in accordance with the protocol in the operator 15 for the case in which the door 14 is descending and an obstruction is sensed. Similarly, if the door 14 is stopped between a completely opened and a completely closed condition, then either the first switch will send the door 14 up or the second switch will send the door up in accordance with the existing protocols in the operator 15. Once again, with the series circuit formed with the obstruction sensing circuit open, the door 14 cannot close.

The third switch 75 may be connected to the fifth and sixth terminals by the third set of wires 65 in systems 12 that have a protocol for connection with an alarm system within the building. Depending on whether the configuration of the alarm system operates as normally closed or normally opened, the third set of wires 65 may be connected in series as shown or in parallel. The third pair of wires 65 may thus send a signal that actuates the alarm system when a fusible link breaks and the switch actuator is released. Alternatively or additionally, the third switch or an additional switch may be connected directly to an audio and/or visual indicator or alarm associated with the actuator(s) (and release device to be described below).

The fourth switch 77 may be connected to a seventh and eighth terminal by a fourth pair of wires 69 as a fail safe measure for sending the door 14 up if the first and second switches 71 and 73 fail to cause the door 14 to go up, in a case of a burned switch or wires. Alternatively, the fourth switch may replace the function described above with regard to the first and second switches 71 and 73 by causing the door 14 to go up when a fusible link breaks and the fourth switch is actuated. A protocol may be provided in the operator to respond to such a signal and preferentially open the door 14 under such emergency conditions.

It is to be understood that while a specific example has been shown and described herein, the same function may be achieved by a different combination of parallel and/or series connections without departing from the spirit and scope of the invention. For example if the push button circuit 24 were to operate in a normally closed condition so that opening the circuit 24 actuates the door 14, then a parallel connection of the first pair of wires would have to be replaced by a series connection. Similarly, the switches need not be initially held in a condition opposite from their at rest condition. The circuitry may be adjusted to accommodate such modifications.

FIG. 5 is a diagrammatic view of the operator 15 and the door opening actuator 10. As shown, the terminal strip 21 may include first through eighth terminals, which may be connected to the first through the fourth switches 71, 73, 75, and 77. In this diagram, the switches are shown as separately housed switches that have respective buttons. A switch actuator 105 may be moved between an engaging and a non-engaging position as shown in solid and dashed lines. This switch actuator 105 may be a combination of levers 90, 96, and 99, or may be a single member. The switch actuator 105 may be coupled to one or more fusible links 33. The switch actuator may also be coupled by the sash 30 to the anchor 36 for engagement in a structural member of the building in which the door opening actuator is to be installed.

As indicated by the plurality of fusible links 33 and the plurality of guide rollers 31, the sash may be routed to any location within the building, and may be used to selectively distribute fusible links throughout the building. For example, a first fusible link 33 may be located proximate to the operator 15. A second fusible link may be located on an opposite side of a wall such as the drywall ceiling 45 for response to a fire or associated heat that may be temporarily isolated to a volume within the attic. Other locations in the attic may be monitored similarly by a long sash that may extend to remote positions in the attic as shown in FIG. 1. Thus, if any of the fusible links breaks, then the door opening actuator will be actuated and will in turn cause the operator 15 to raise the associated overhead door 14. In some applications, the sash may be connected to a plurality of doors. For example, the sash may interconnect multiple doors of a distribution dock facility so that one or more doors is actuated when the sash is slackened.

FIG. 5 also include a timing device 108 that may be operably connected to the switches 71, 73, 75, and 77. This timing device may be desirable in some circumstances in order to delay the opening of the door 14. For example, the timing device could delay causing actuation of the door for approximately five to ten minutes so that the fire may be isolated for the short period of time between notification of the fire department and their arrival. This may be beneficial for buildings that have an alarm system that automatically notifies the fire department. However, the safety issues of a need for egress will usually override any advantage that a timing device may provide.

The door raising actuator 10 may also include a backup power supply 112 that may be connected to the operator and/or time delay device 108. The battery backup may include one or more batteries and may have sufficient power to raise the door completely and actuate any alarms.

Figure 6:
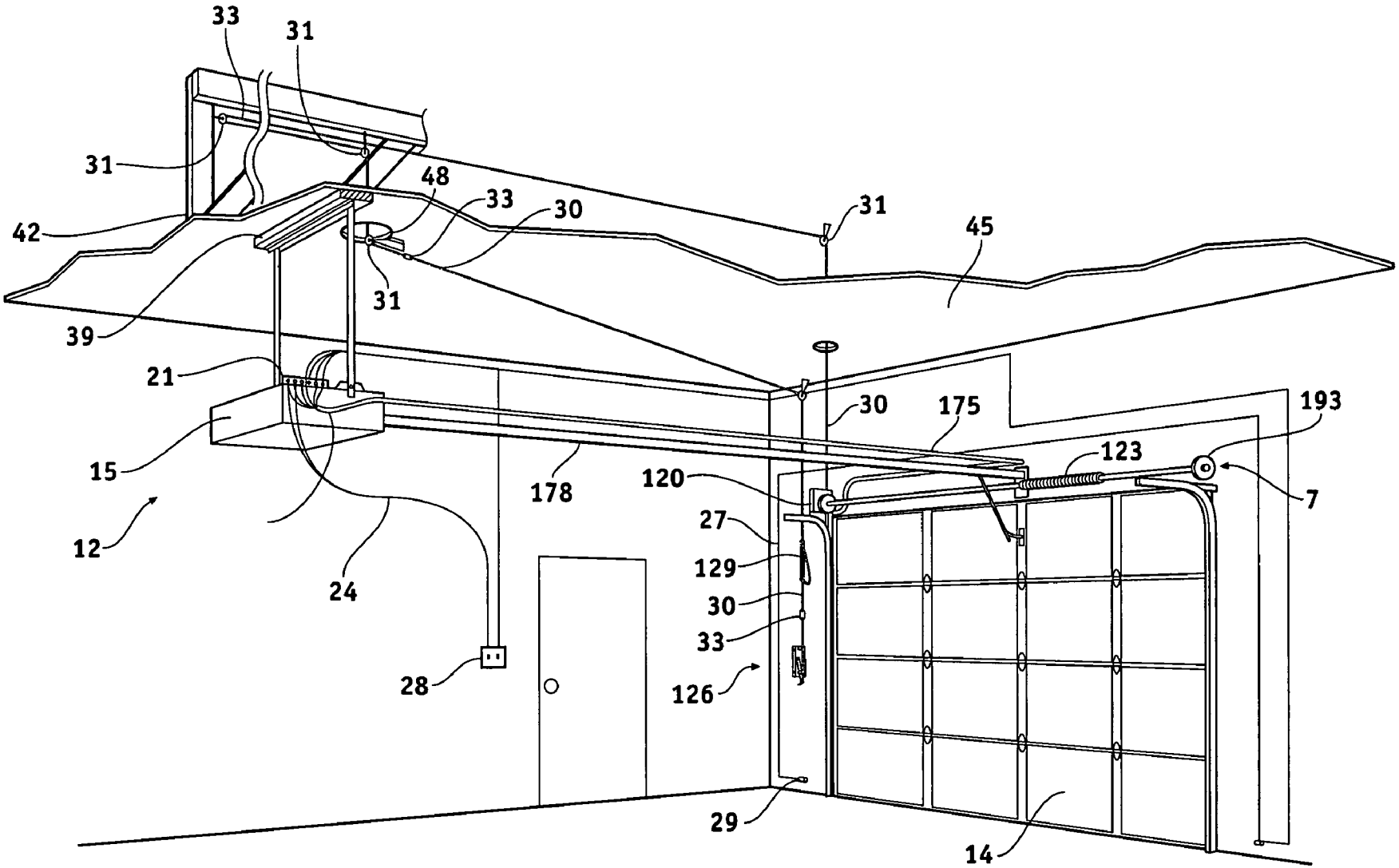
FIG. 6 is a perspective view of an emergency door opening actuator operatively connected to an operator and a manual release mechanism in an overhead door system according to an embodiment of the present invention.

FIG. 6 is a perspective view similar to FIG. 1 with a door opening actuator 120 mounted at a location that is separate from the operator 15. The door opening actuator 120 in this case may be mounted on structural members near one side edge of the overhead door 14, and may receive an end of a spring shaft 123 therethrough. Housings for the door opening actuator may be configured for selectively mounting on either end of the spring shaft 123.

Figure 9B:
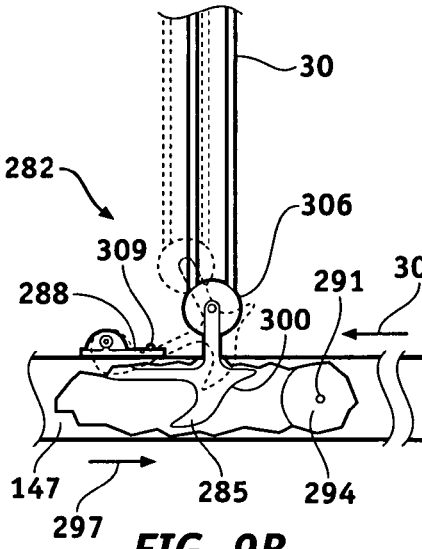
FIG. 9B is a side view of a stop mechanism that may be connected with any emergency door opening actuator such as that shown in FIG. 1 or FIG. 6 in accordance with an alternative embodiment of the invention.
Figure 7:
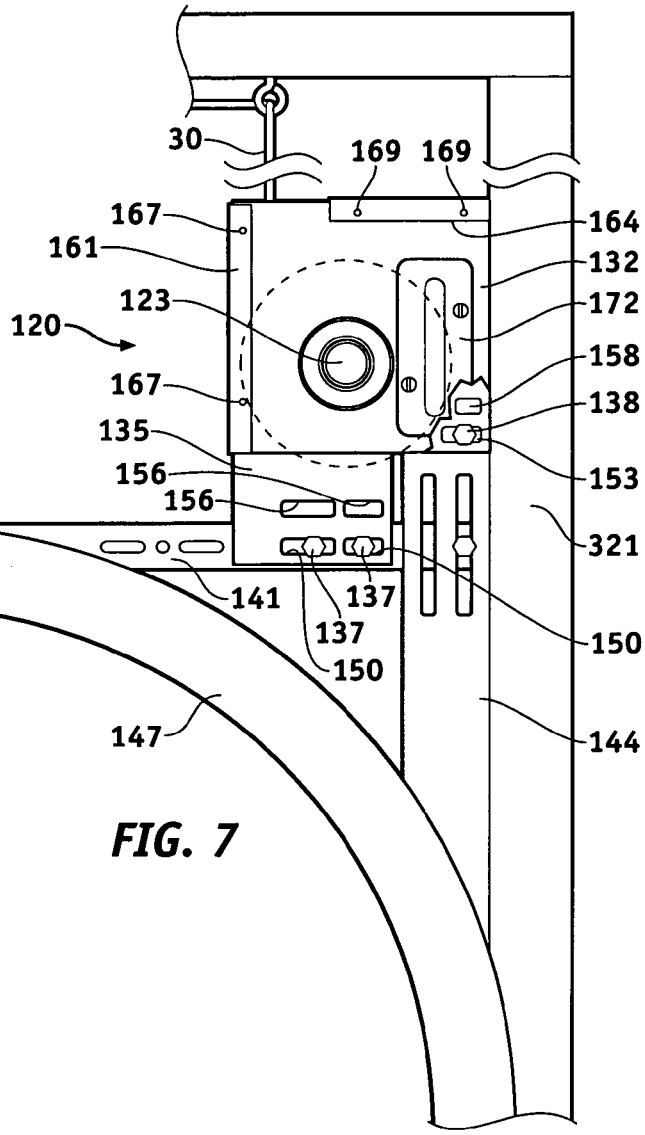
FIG. 7 is a side view of the emergency door opening actuator of FIG. 6.
Figure 8:
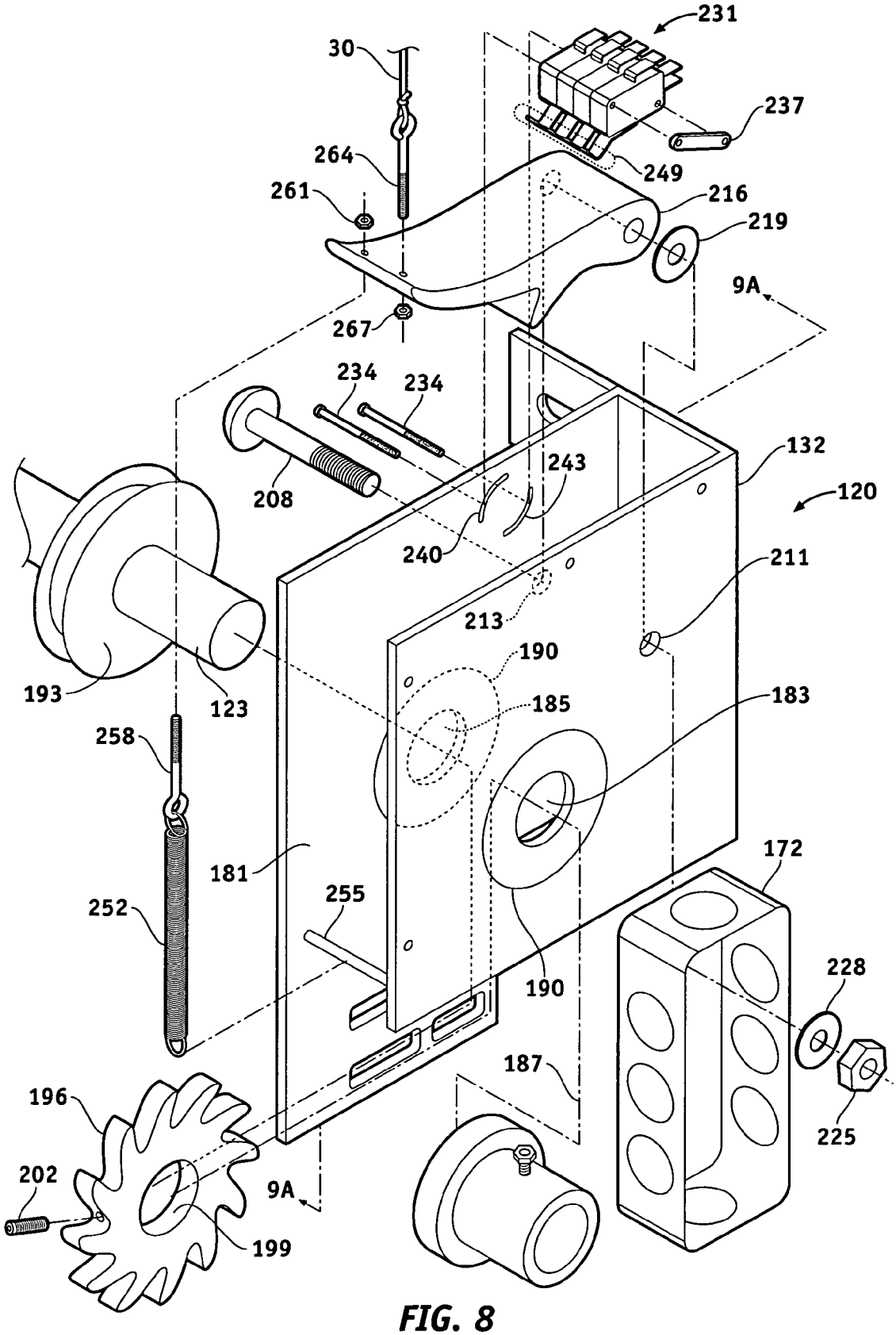
FIG. 8 is an exploded view of the emergency door opening actuator of FIGS. 6, and 7.
Figure 9A:
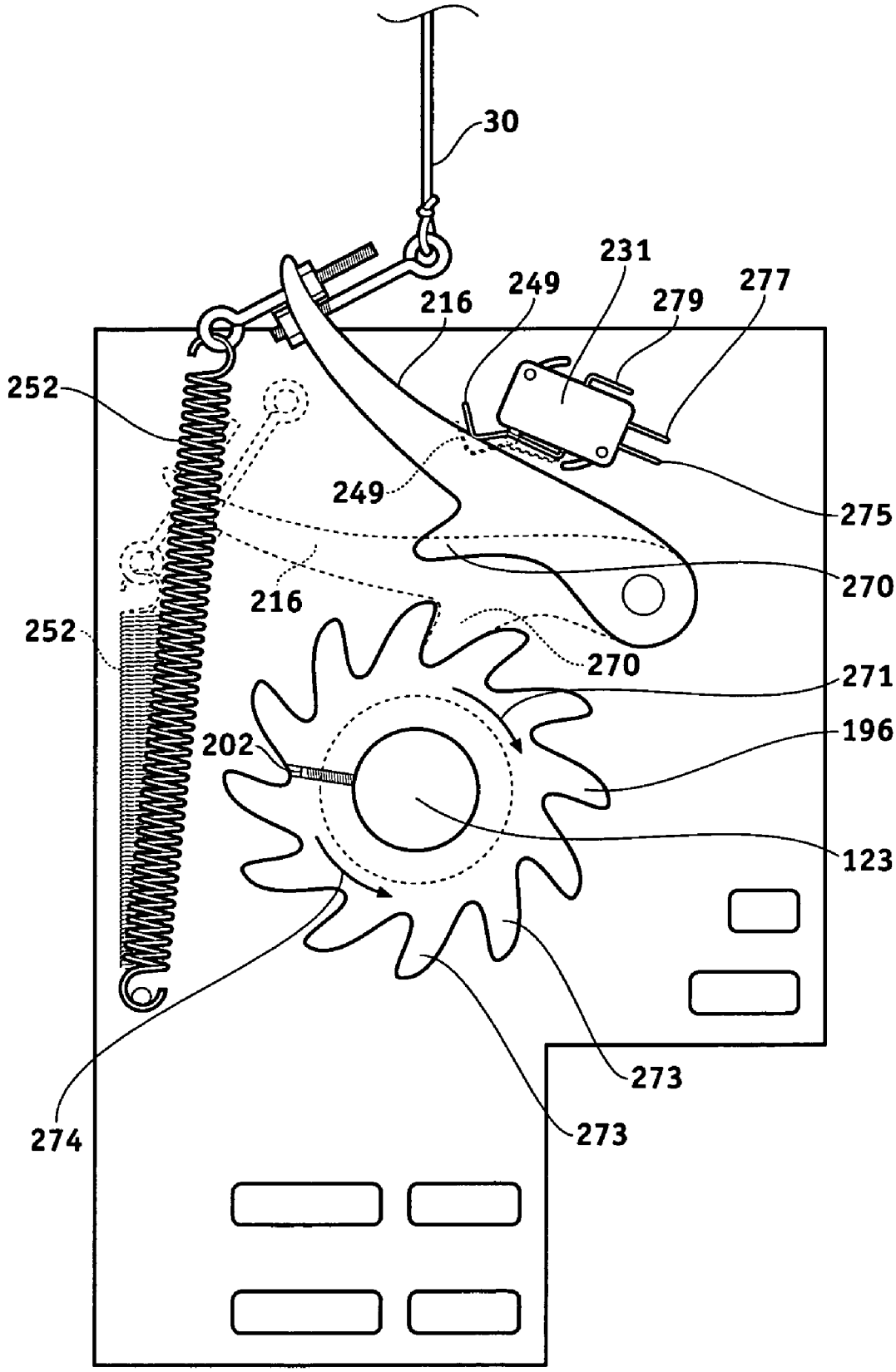
FIG. 9A is a diagrammatic sectional view taken along lines 9A-9A of FIG. 8 of the emergency door opening actuator in an assembled state.

The door opening actuator 120 has a housing configured for receipt on a left end of the spring shaft as viewed in FIG. 6. A mirror image of the housing of the door opening actuator 120 is shown in FIGS. 7, 8, and 9A. The housing of FIGS. 7, 8, and 9A is for mounting the door opening actuator on an opposite end of the spring shaft 123, as may be appreciated.

A sash 30 may connect the door opening actuator 120 with a test release mechanism 126. The sash 30 may be of any desired length, and may include any number of fusible links 33 that may be selectively placed throughout the building in which the overhead door 14 is installed. As shown, the sash 30 may be tensioned over a multitude of rollers 31 or other guides so that when tension is released in the sash 30, switches in the door opening actuator 120 may be released as will be described in greater detail below. As shown in FIG. 6, a tensioning spring 129 may be provided at one or more positions along a length of the sash 30 to allow for tolerancing and provide constant tensioning when the sash is not released.

In FIG. 7, the door opening actuator 120 is shown as it would appear when mounted on a right most end of the spring shaft 123 as viewed in a direction of arrow 7 in FIG. 6. The door opening actuator 120 has a housing 132 that may be mounted by an integral downwardly extending plate 135 and a plurality of fastening members 137 and 138 to existing structural members 141 and 144 that regularly hold the overhead door track or roller guide 147 in place, as shown.

When supported on the existing structural members 141 and 144, the housing 132 may be configured to receive the spring shaft 123 therethrough. The fasteners 137 and 138 may be received in lower slots 150 and 153. Upper slots 156 and 158 enable vertical adjustment of the door opening actuator 120. The elongate structure of the slots 150, 153, 156, and 158 enable adjustment of the mounting position of the housing 132 in a horizontal direction.

The housing 132 may have a vertical cover 161 and a horizontal cover 164 for enabling easy access to an interior of the housing 132. To this end, respective screws 167 and 169 may secure the covers 161 and 164 in covering relation on the housing 132 during regular operation. A junction box 172 may receive a line 175 containing a set of wires generally analogous to the wires of line 18 in FIG. 1. The line 175 is shown in FIG. 6 extending from the same terminals of the operator 15 as the wires of line 18 in FIG. 1. However, as shown in FIG. 6, the line 175 may be extended along an overhead door track 178 to a wall above the overhead door 14, and may be run along the wall to the door opening actuator 120. The junction box 172 shown in FIG. 7 may include removable slugs for selectively directing the line 175 into an interior of the housing 132. The junction box 172 may also have a conventional clamping mechanism for securing the line 175 to the housing near the end of the line 175 that is to be attached to switches in the interior of the housing 132.

FIG. 8 is an exploded view of the door opening actuator 120 of FIG. 7 and shows the interior 181 and various components that are received therein in an assembled state. Front and rear openings 183, 185 are centered on a common axis 187 and are adapted to receive the spring shaft 123 therethrough. Bearings 190 may be provided in the openings 183, 185 to enable uninhibited rotation of the spring shaft 123 within the housing 132 during regular operation.

As may be appreciated, the door opening actuator 120 may be installed on the spring shaft 123 with the housing 132 abutted against an outwardly facing surface of a cable drum 193. During installation, a star gear 196 may be inserted into the interior 181 of the housing 132 and centered on the axis 187. Thus positioned, the star gear 196 may receive the spring shaft 123 through a center hole 199 of the star gear 196. In this way, the star gear 196 is a shaft engaging element and may be fixed to the shaft by a set screw 202. Once fixed to the spring shaft 123, the star gear 196 will rotate together with the spring shaft 123 during regular operation. A shaft collar 205 may be fixed to an outer end of the spring shaft 123 adjacent to an outer surface of the housing 132 to inhibit relative axial movement between the housing 132 and the spring shaft 123.

In order to support another component within the housing 132, a bolt 208 may extend through front and rear pawl lever mounting apertures 211, 213. The bolt 208 may rotatably mount the pawl lever 216 within the housing 132. The pawl lever 216 may have a through opening 219 for receiving the bolt 208 therethrough. A spacer 222 may help position the pawl lever 216 on the bolt 208. A threaded end of the bolt 208 may be received through the front aperture 211 and may be secured by a nut 225 and washer 228. Thus, the bolt 208 may provide an axle on which the pawl lever 216 may rotate. As shown in the embodiment of FIG. 8, the bolt 208, the nut 225, and the washer 228 may also hold the junction box 172 in place on an outer surface of the housing 132.

A set of micro switches 231 may be secured in an interior of the housing 132 by screws 234 that may extend through the micro switches 231 and threadedly engage a plate 237. The screws 234 may extend through holes 240 and 243 in the rear wall of the housing 132. Either one or both of the holes 240 and 243 may be arcuately configured to enable angular adjustment of the set of micro switches 231 within the housing 132. Each micro switch of the set 231 may have a button 246 engaged with and depressable by respective limit arms 249. These limit arms 249 are pivotally connected to the micro switches 231 at first ends thereof and extend outwardly away from the micro switch for engagement by a mechanical member. In this case, the mechanical member may be provided by the pawl lever 216.

The pawl lever may be biased toward an engaged position by a spring 252. The spring 252 may be connected at a first end to a pin 155 fixed to the housing 132 and an eye bolt 258 that may be secured to the pawl lever 216 by a nut 261. The sash 30 shown and described in FIG. 6 may extend into the interior 181 of the housing 132 and be secured to the pawl lever 216 by an eye bolt 264 and a nut 267. Thus, when the sash 30 is tensioned for regular operation of the system, the pawl lever 216 is pulled against the bias of the spring 252 into a non-engaging position in which a pawl 270 of the pawl lever 216 is held in spaced relation relative to the star gear 196.

FIG. 9A is a diagrammatic sectional view taken generally along the lines 9A-9A of FIG. 8 clearly depicting the relative positions of the pawl lever 216, the spring 252, the limit arms 249, and the star gear 196. As shown, when tension is released on the sash 30 in an emergency or test situation, the spring 252 is released from a position shown in solid lines and moves to a contracted state shown in dashed lines. Likewise, the pawl lever 216 moves from a position indicated in solid lines to a position shown in dashed lines. The integral pawl 270 on the pawl lever 216 likewise moves into the position indicated by dashed lines and engages the star gear 196. Since the star gear is fixed to the spring shaft 123 by the set screw 202, the spring shaft 123 is inhibited from movement in the clockwise direction 271 as viewed in FIG. 9A when the pawl lever has been released such as in an emergency or test situation, for example.

In a practical application, this locking engagement of the pawl with the star gear 196 may prevent an overhead door from closing during an emergency such as a fire. On the other hand, an angle of the pawl 270 relative to the splines 273 on the star gear and the resilient releaseability of the pawl lever 216 due to the resilient flexibility of the spring 252, the star gear and the spring shaft 123 are free to move in the counterclockwise direction 274 even though the pawl lever 216 is released and urged to the position shown in dashed lines. Thus, the star gear 196 and spring shaft 123 may allow the door 14 to go up under control of the operator 15, and an advantageous safety mechanism may be provided in which the overhead door 14 is permitted to open but is prevented from closing.

Similar to the spring levers 96 and 99 in the embodiments shown and described with regard to FIGS. 1-5, the limit arms 249 transfer sufficient forces and reduce harmful forces. That is, the limit arms 249 are somewhat flexible so that excessive forces applied by the pawl lever 216 to the limit arms 249 will simply bend the limit arms 249 and not damage the micro switches 231 and their respective buttons 246. The micro switches 231 have respective first, second, and third electrical leads 275, 277, and 279. A pair of these leads 275, 277, and 279 may be connected similarly to the connections of pairs of wires to the switches 71, 73 shown and described with regard to FIGS. 2-5. A first lead may provide a normally open circuit, a second lead may provide a normally closed circuit, and a third lead may provide a common for either of the first and second leads. The micro switches 231 may be connected to the operator 15 in the same way via the set of wires within the line 175 so that the door may be caused to open in an emergency or test situation under operator control in accordance with the same method described above. With separate respective buttons 246, the switches set of wires within the line 175 may be connected to the leads 275, 277, and 279 so that all the wires in line 175 may be connected to the terminal 21 in series. Thus, installation can be simplified.

The embodiments shown in FIGS. 6-9A have the advantage of an additional mechanism, which is mechanical, that provides redundancy for preventing an overhead door from closing in an emergency for a test situation. This redundancy, especially since it includes a mechanical fail safe stop, is exceedingly advantageous under conditions in which wiring may be burned or otherwise destroyed to a point that the door may not be held opened under operator control. In fact, the mechanical stop of the present invention may be an improved substitute for a conventional method implemented by firefighters in which they manually prop an overhead door in an open position with a 2×4 or other beam.

A mechanical stop associated with a door opening actuator may be provided in any of a variety of combinations. For example, the mechanical stop comprising the star gear 196 and the pawl lever 216 with pawl 270 may be implemented at the end of the spring shaft similar to the embodiment shown in FIGS. 6-9A while the micro switches may be implemented at the operator similar to the embodiment shown and described with regard to FIGS. 1-5.

Furthermore, other types of mechanical stops may be implemented with any door opening actuator that has switches associated with the operator in accordance with the present invention. For example, a mechanical stop 282 may simply include a hook 285 rotatively mounted by a bracket 288 on a door crack 147, as shown in FIG. 9B. The hook 285 may be positioned to engage an axle 291 of a door roller 294 and inhibit movement of the axle and the door in a closing direction 297. On the other hand, the hook 285 may have a ramp 300 positioned for engagement by the axle 291 when the door moves in an opening direction 303. When the axle 291 engages the ramp 300 during opening of the door, the hook member 285 may simply be lifted by the engagement of the ramp 300 with the axle 291 and may be guided up and over the axle 291 so that the door is permitted to open. On the other hand, the door 14 may be prevented from closing when the hook member 285 is in an engaging position shown in FIG. 9B since the hook 285 will stoppingly engage the axle 291 of the next roller 294. The position of the hook 285 shown in FIG. 9B is a released position that occurs during an emergency or a test situation when tension in the sash 30 has been released. Under regular operating conditions, the hook member 285 may be rotated upwardly out of the position shown. The hook member 285 may thus be rotated against the force of gravity or the bias of a spring (not shown) so that the hook member 285 reaches a position shown in dashed lines in FIG. 9B and does not engage axles 291 of a overhead door when it is being closed and when it is being opened. As shown, the sash 30 may extend around a pulley 306 connected to the hook member 285 and the hook member 285 may be rotated out of the engaging position when the sash 30 is properly tensioned. The hook member may engage a positive stop element 309 that may be integral with the mounting bracket, for example.

Figure 10A:
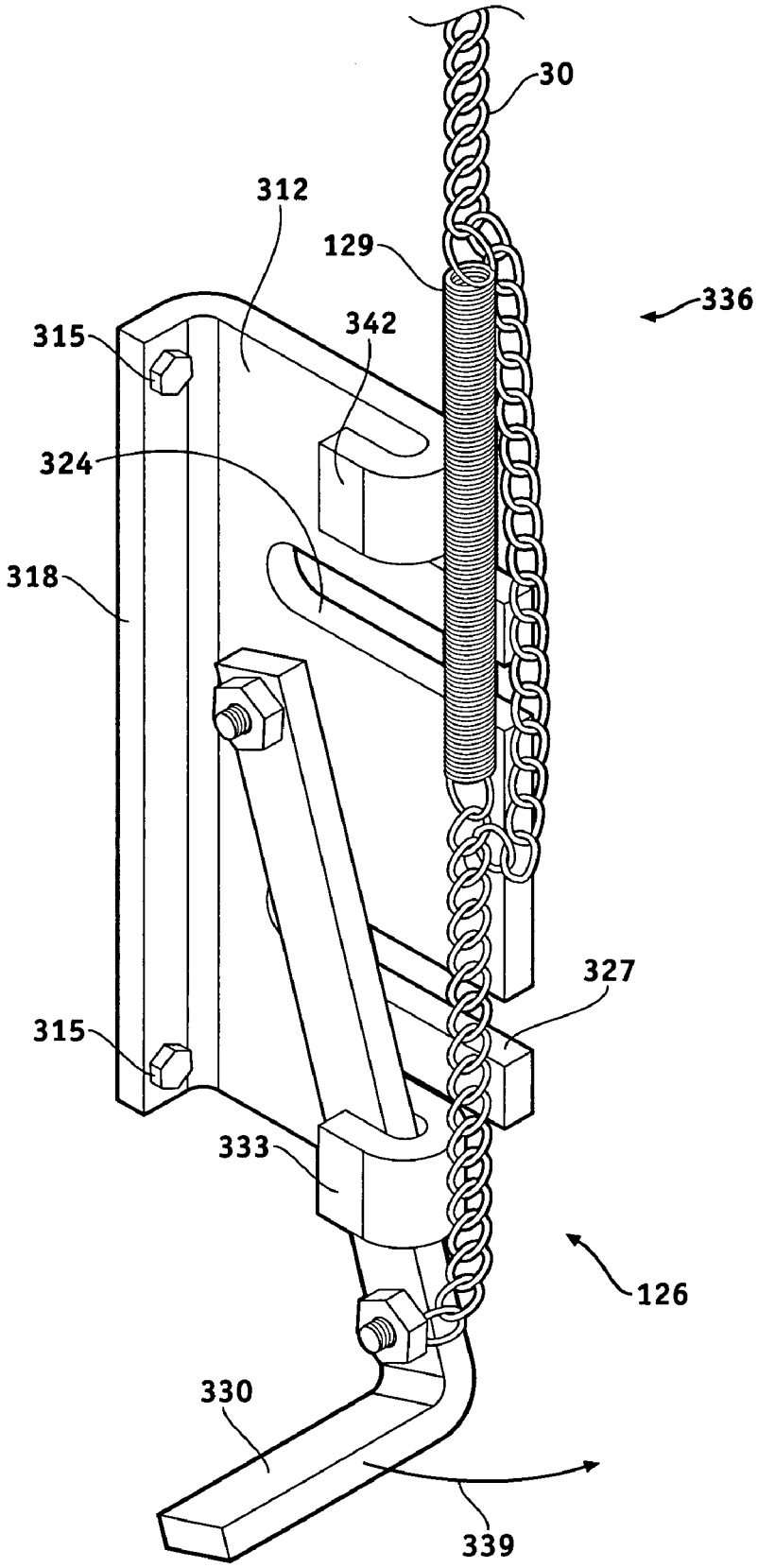
FIG. 10A is a perspective view of a releaseable lever and mounting mechanism.

FIG. 10A is a perspective view of the test release mechanism 126 that additionally forms an anchor for one end of the sash 30 of the present invention. The release mechanism may comprise a mounting bracket 312, which in FIG. 10A has been rotated by 180 degrees about one axis, and rotated by 90 degrees about another perpendicular axis relative to the position shown in FIG. 6. This reorientation demonstrates the versatility of the mounting bracket 312. For example, fasteners 315 may be extended through holes in a narrow flange 318 and engaged in a door jam such as element 321 shown in FIG. 7. Alternatively, the fasteners 315 may be engaged through one or both of slots 324 and 327 in a broad flange 328. The orientation of the bracket 312 may be adjusted to fit the needs or convenience of a user or to fit with a particular wall or building structure.

The bracket 312 may be mounted on a wall or door jam at a vertical position in which the sash 30 will be taunt with a release lever 330 engaged by a tensioning catch 333. Tolerancing may be achieved by providing the tensioning spring 129 that forms an expandably retracted section 336 in the sash 30. When a user desires to test the system by releasing the sash 30, he or she may grasp the release lever 330 and move it out of engagement with the tensioning catch 333 against the bias of one or more of the springs of the system and then release the lever to permit the release lever 330 to be biased with the sash 30 and rotate into a slack condition. To this end, the user may move the release lever 330 outward to clear the tensioning catch 333 and rotate the release lever 330 in a counterclockwise direction 339 upwardly to a release position and engage the release lever 330 in the release catch 342. When proper functioning of the system has been verified, the user may return the release lever 330 to the locked position engaged with the tensioning catch 333.

Figure 10B:
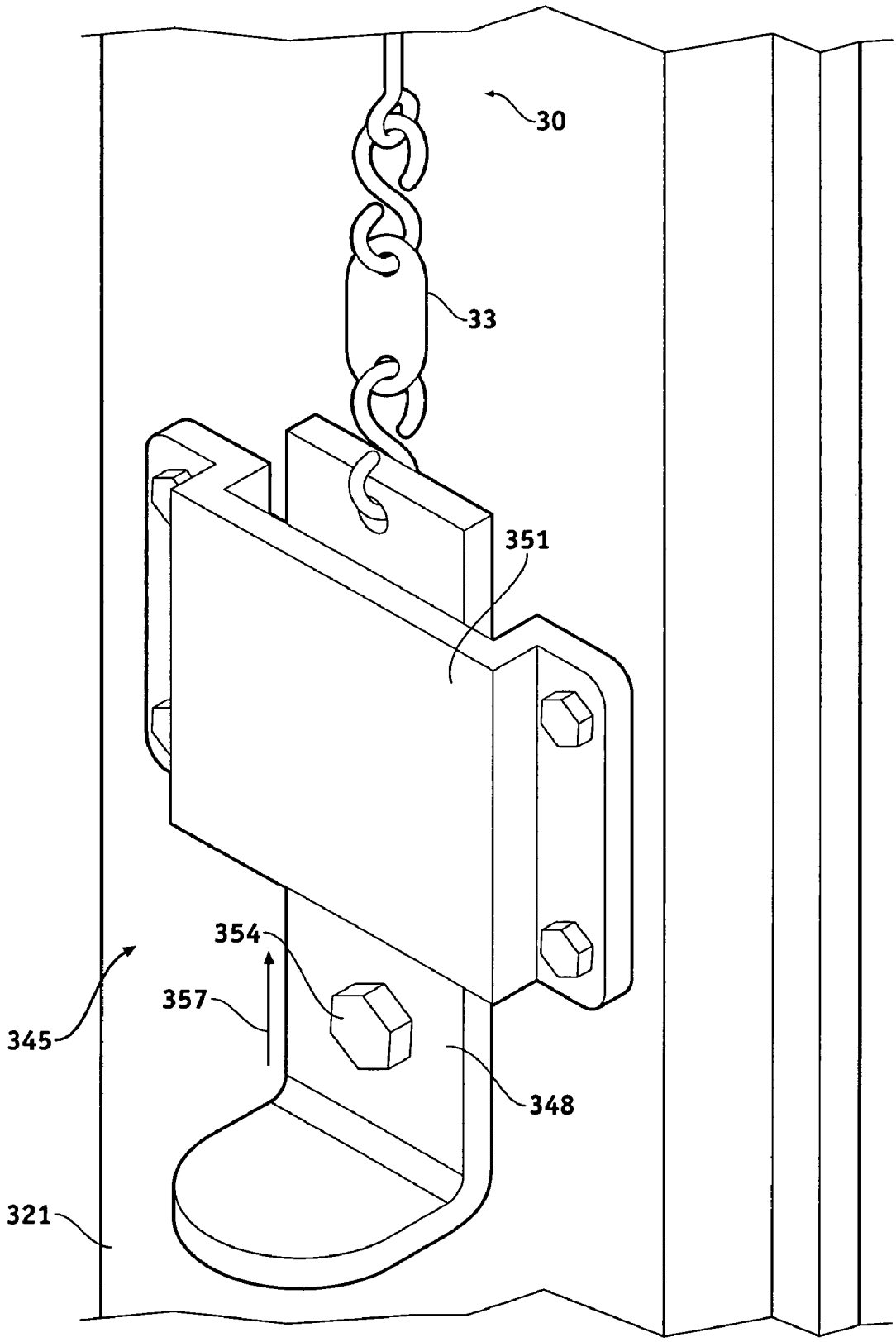
FIG. 10B is a perspective view of a releaseable lever and mounting mechanism in accordance with an alternative embodiment.

FIG. 10B shows a front perspective view of another test release mechanism 345 in accordance with another embodiment, which may be used in place of release mechanism 126 of FIGS. 6 and 10A. In this case, a release lever 348 may be slidably held to a door jam 321 by a bracket 351. The sash 30 may be tensioned as described above, and the sash may be held in a tensioned state during regular use of the system by securing the release lever 348 in a retracted position by a bolt or other fastener 354 as shown in FIG. 10B. When a user desires to test the system he or she may simply remove the fastener 354 and permit the release lever 348 to move in a protracted direction 357 that in turn releases tension in the sash 30. After testing, the lever 348 may be returned to a retracted position shown in FIG. 10B and the fastener replaced to hold the lever 348 in place.

While the mechanical stop mechanism has been shown and described in specific structural detail, it is to be understood that many variations may be implemented without departing from the spirit and scope of the invention. For example, while the micro switch buttons, limit arms or spring levers, and pawl lever or switch actuator have been shown as separate components working together, it is to be understood that two or more of these components may be formed as a single component without departing from the spirit and scope of the invention. For example, a switch button could be directly connected to a sash for direct actuation. On the other hand, additional intermediate elements may be incorporated in a mechanical leakage relationship that still functions within a cause and effect actuation that is within the spirit and scope of the present invention. Also, in this regard, the switch actuator may be considered to comprise more than one of the components in the mechanical linkage relationship and or additional elements. Such configurations are considered to be within the spirit and scope of the invention as long as the mechanical cause and effect relationship of the linkage ultimately actuates the switch buttons in response to tensioning or releasing a sash that comprises or is connected to fusible links. Also within the spirit and scope of the invention is a switch actuator that may include the sash and/or fusible links.

Any mechanical stop may be used with or without the emergency door opening actuator that includes switches. However, as described with regard to the hook version of a mechanical stop, any mechanical stop may be connected to an emergency door opening actuator by the physical or mechanical linkage of a sash. As may be appreciated, the sash may comprise a chain, a cable, a wire, and/or other elements.

While the present invention has been described with regard to a spring shaft, it is to be understood that the shaft may more generally be any door lifting shaft including an actual door axle on which a door is wrapped or any shaft that is driveably engaged with a movement of the door. For example, when a star gear is engaged by a pawl to inhibit movement of a door in a closing direction, the star gear need only be fixed to a shaft that is driveably engaged with the door or that is driveably moved when the door moves. Similarly a mechanical stop of any configuration need only be stoppingly engageable with elements that are driveably moved in response to movement of the door so that stopping engagement of the mechanical stop also inhibits movement of the door.

While the systems of the present invention have been described as responsive to slack in a sash due to any emergency or test condition, and while the systems have been described as sending a signal to an existing alarm system under such emergency or test conditions, it is to be understood that the system of the present invention may also be actuated by an existing alarm system. That is, when an alarm condition is sensed by an existing alarm system, that alarm system may send a signal to the overhead door operator via one or more switches of the present invention to cause the overhead door to be opened automatically and to prevent the door from closing as has been described with regard to emergencies or tests above. Thus, the present invention may also advantageously provide an emergency door opening actuator that may be tied to an existing alarm system for greater safety in the event of an emergency sensed by the alarm system.

Several advantages are provided by the present invention. Of greatest importance, an escape route may be provided by actuation of the door in accordance with the present invention. Such actuation of the door may be caused by the emergency door opening actuator 10 of the present invention. Furthermore, entry through the garage door is one of the second most preferred modes of entry for fire fighters attempting to enter a burning house. With the present invention, the garage door will be automatically opened and locked in the opened position. Therefore, entry therethrough may be facilitated and may become the preferred mode of entry. Other advantages of the present invention may include the fact that opening the garage in accordance with the present invention may draw the fire away from other parts of the home and into the garage by feeding oxygen to the fire at the garage door.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, while the present invention has been shown and described as formed of micro-switches and relatively large switch actuators that engage the switches, analogous circuitry may be incorporated on a circuit board or as a microcircuit. Also, the actuator has been shown and described as mounted on a particular spring shaft and associated end plate. However, it is to be understood that the actuator of the present invention may be adapted to any end bearing fixture and/or end plate. While the test release mechanism of the present invention has been described primarily as a mechanical device, it is to be understood that an analogous electrical or electromechanical device may be substituted therefor without departing from the spirit and scope of the invention.

While the actuation lever 90, pawl lever 216, and stop 285 are shown as being pulled in an upward direction when the sash is tensioned, it is to be understood that any one of these levers and stop may be reoriented so that tensioning the sash exerts a force in some direction than upward to accommodate the structural requirements of a building in which the respective actuators are to be installed. Alternatively, a direction changing lever may be added so that tensioning the sash applies a downwardly directed force on the direction changing lever, which in turn applies an upwardly directed force via the direction changing lever to the actuation lever 90, pawl lever 216, or stop 285 on an opposite side of a fulcrum of the direction changing lever. Thus, the actuator may be accommodated in buildings having very limited overhead space, for example. The direction changing lever may be of any form including a boomerang shape and may have a roller or other friction reducing mechanism for engaging an underside of the pawl lever, for example.

The release mechanism(s) of the present invention may be operatively connected to a knox box, key box, key switch, microswitch, or similar device that is mounted outside of a building for securely storing entry keys, floor plans and/or otherwise permitting access by a fire department in case of an emergency. The release mechanism(s) of the present invention may be configured to interface with any of the fire department access devices that are mounted outside so that actuation of the access device automatically releases the release mechanism and/or the sash. For example, the release mechanism may be tied into a knox box so that actuation of the knox box by the fire department automatically releases the release mechanism. The interface may be electrical and actuate the release mechanism via a solenoid. Alternatively, the interface may be mechanical or may utilize a wireless connection.

Additionally, while the present invention has been shown and described with regard to opening an overhead door in an emergency, the same principles could be used for closing doors in case of emergencies. Doing this is desirable in some applications similar to fire door applications in which isolation of a fire is the goal. In this regard, the present invention has application in residential garage doors and commercial applications for both opening and closing overhead doors.

The invention claimed is:

1. A door system, comprising:

an operator operatively coupled with a door;

a first door opening actuator operatively coupled with the operator, the first door opening actuator including a switch actuator and a switch;

a first fusible link coupled with the switch actuator with a sash, wherein the switch actuator activates the switch in response to the first fusible link breaking; and a second door opening actuator operatively coupled with the door through a shaft, the second door opening actuator including a mechanical stop operatively coupled with the shaft, and a microswitch operatively coupled with the switch.

2. The system of claim 1, further including a pawl which operatively couples the mechanical stop with the microswitch.

3. The system of claim 2, further including a second fusible link coupled with the pawl with the sash.

4. The system of claim 3, wherein the pawl is biased to move from a position disengaged from the mechanical stop to a position engaged with the mechanical stop in response to the second fusible link breaking.

5. The system of claim 4, wherein the door is restricted from closing in response to the pawl engaging the mechanical stop.

6. The system of claim 5, wherein the switch is activated by the microswitch in response to the pawl moving from the disengaged position to the engaged position.

7. The system of claim 6, wherein the door opens in response to activating the switch.

8. A door system, comprising:

an operator operatively coupled with a door;

first door opening actuator operatively coupled with the operator, the door opening actuator including a switch actuator and first and second switches;

a first fusible link coupled with the switch actuator with a sash, wherein the switch actuator activates the first and second switches in response to the first fusible link breaking;

a second door opening actuator operatively coupled with the door through a shaft, the second door opening actuator including a mechanical stop operatively coupled with the shaft, and a microswitch operatively coupled with the first and second switches;

a pawl which operatively couples the mechanical stop with the microswitch; and a second fusible link coupled with the pawl with the sash.

9. The system of claim 8, further including a spring which biases the pawl to move from a position disengaged from the mechanical stop to a position engaged with the mechanical stop in response to the second fusible link breaking.

10. The system of claim 9, wherein the door is restricted from closing in response to the pawl moving from the disengaged position to the engaged position.

11. The system of claim 8, wherein the first and second switches are activated by the microswitch in response to the pawl moving from the disengaged position to the engaged position.

12. The system of claim 11, further including a push button circuit operatively coupled with the first switch, wherein the door opens and closes in response to activating and deactivating, respectively, the push button circuit.

13. The system of claim 12, wherein the push button circuit is activated by the first switch in response to the pawl moving from the disengaged position to the engaged position.

14. The system of claim 11, further including an obstruction sensor circuit operatively coupled with the second switch, wherein the door opens in response to activating the obstruction sensor circuit.

15. The system of claim 14, wherein the obstruction sensor circuit is activated by the second switch in response to the pawl moving from the disengaged position to the engaged position.

16. A door system, comprising:

an operator operatively coupled with a door;

first door opening actuator operatively coupled with the operator, the first door opening actuator including a switch actuator and first and second switches;

a first fusible link coupled with the switch actuator with a sash, wherein the switch actuator activates the first and second switches in response to the first fusible link breaking;

a second door opening actuator operatively coupled with the door through a shaft, the second door opening actuator including a mechanical stop operatively coupled with the shaft, and a microswitch operatively coupled with the first and second switches;

a pawl which operatively couples the mechanical stop with the microswitch; and a second fusible link coupled with the pawl with the sash;

wherein the first and second switches are activated by the microswitch in response to movement of the pawl.

17. The system of claim 16, wherein the pawl is biased to move from a position disengaged from the mechanical stop to a position engaged with the mechanical stop in response to the second fusible link breaking.

18. The system of claim 16, further including a test release device operatively coupled with the door opening actuator through the sash and a third fusible link.

19. The system of claim 18, wherein tension in the sash is increased and decreased in response to deactivating and activating, respectively, the test release device.

20. The system of claim 16, further including an alarm system, wherein the pawl engages the mechanical stop in response to an emergency indication from the alarm system.

* * * * *

UNITED STATES PATENT AND TRADEMARK OFFICE

CERTIFICATE OF CORRECTION

PATENT NO. : 7,574,826 B2
APPLICATION NO. : 11/084667
DATED : August 18, 2009
INVENTOR(S) : Rob J. Evans It is certified that error appears in the above-identified patent and that said Letters Patent is hereby corrected as shown below:

IN THE CLAIMS:

Column 15, line 28 claim 8, before “first” insert --a--.

Column 15, line 39 claim 8, before “door” insert --first--.

Column 16, line 25 claim 16, before “first” insert --a--.

Signed and Sealed this
Twenty-first Day of June, 2011

David J. Kappos

David J. Kappos
*Director of the United States Patent and Trademark Office*